US007183213B2

(12) United States Patent
Shiho et al.

(10) Patent No.: US 7,183,213 B2
(45) Date of Patent: Feb. 27, 2007

(54) CHEMICAL MECHANICAL POLISHING PAD AND CHEMICAL MECHANICAL POLISHING METHOD

(75) Inventors: Hiroshi Shiho, Tokyo (JP); Yukio Hosaka, Tokyo (JP); Kou Hasegawa, Tokyo (JP); Nobuo Kawahashi, Tokyo (JP)

(73) Assignee: JSR Corporation, Tokyo (JP)

( * ) Notice: Subject to any disclaimer, the term of this patent is extended or adjusted under 35 U.S.C. 154(b) by 136 days.

(21) Appl. No.: 10/892,096

(22) Filed: Jul. 16, 2004

(65) Prior Publication Data

US 2005/0014376 A1 Jan. 20, 2005

(30) Foreign Application Priority Data

Jul. 17, 2003 (JP) ..... 2003-275740

(51) Int. Cl.
*H01L 21/302* (2006.01)

(52) U.S. Cl. ..... 438/692; 438/8; 451/56

(58) Field of Classification Search ..... 438/8, 438/689, 690, 691, 692, 693; 451/56, 526
See application file for complete search history.

(56) References Cited

U.S. PATENT DOCUMENTS 6,117,000 A 9/2000 Anjur et al.
6,387,312 B1 * 5/2002 Roberts et al. ..... 264/328.16
6,458,014 B1 * 10/2002 Ihsikawa et al. ..... 451/6
6,641,471 B1 * 11/2003 Pinheiro et al. ..... 451/526
6,910,944 B2 * 6/2005 Birang et al. ..... 451/6
2003/0124956 A1 * 7/2003 Wiswesser et al. ..... 451/6
2005/0014376 A1 1/2005 Shiho et al.

FOREIGN PATENT DOCUMENTS

| | | |
|---|---|---|
| EP | 1 252 973 | 10/2002 |
| EP | 1 252 973 A1 * | 10/2002 |
| JP | 9-7985 | 1/1997 |
| JP | 11-512977 | 11/1999 |
| JP | 2000-326220 | 11/2000 |
| KR | 2001-0053451 | 6/2001 |
| WO | WO 97/06921 | 2/1997 |

OTHER PUBLICATIONS

U.S. Appl. No. 10/529,742, filed Mar. 29, 2005, Shiho et al.

* cited by examiner

*Primary Examiner*—Kin-Chan Chen
(74) *Attorney, Agent, or Firm*—Oblon, Spivak, McClelland, Maier & Neustadt, P.C.

(57) ABSTRACT

A chemical mechanical polishing pad. The pad contains a water-insoluble matrix and Water-soluble particles dispersed in the water-insoluble matrix material and has a polishing surface and a non-polishing surface on a side opposite to the polishing surface. The pad has a light transmitting area which optically communicates from the polishing surface to the non-polishing surface. The non-polishing surface of the light transmitting area has a surface roughness (Ra) of 10 pm or less.

10 Claims, 4 Drawing Sheets

CHEMICAL MECHANICAL POLISHING PAD AND CHEMICAL MECHANICAL POLISHING METHOD

FIELD OF THE INVENTION

The present invention relates to a chemical mechanical polishing pad and a chemical mechanical polishing method. More specifically, it relates to a chemical mechanical polishing pad having an area for improving light transmission without impairing polishing efficiency and a chemical mechanical polishing method using the same.

DESCRIPTION OF THE PRIOR ART

In the chemical mechanical polishing of a semiconductor wafer, after the purpose of polishing is accomplished, the determination of the polishing end point for terminating polishing can be made based on a time obtained empirically. However, various materials are used to form the surfaces to be polished and the polishing time differs by each material. It is conceivable that the material forming the surface to be polished will change in the future. Further, the same can be said of slurry used for polishing and a polishing machine. Therefore, it is extremely inefficient to obtain the suitable polishing time which differs according to the above factors. To cope with this, optical end-point detectors and processes using an optical method capable of directly measuring the state of the surface to be polished are now proposed (JP-A 9-7985 and JP-A 2000-326220) (the term "JP-A" as used herein means an "unexamined published Japanese patent application").

When the above optical end-point detector is used, a window is generally formed in part of the chemical mechanical polishing pad to transmit end-point detection light and the surface to be polished is measured only through this window. JP-A 11-512977 proposes a method of forming a window made of a hard and homogeneous resin in part of a chemical mechanical polishing pad to transmit end-point detection light. According to this technology, although the optical detector can be used advantageously, the area of the window for transmitting end-point detection light in the chemical mechanical polishing pad does not have polishing capability, whereby a reduction in polishing efficiency cannot be avoided and the degree of freedom in the size, shape, number and position of the window is limited.

SUMMARY OF THE INVENTION

It is an object of the present invention which has been made to solve the above problems to provide a chemical mechanical polishing pad having an area for transmitting end-point detection light without reducing the polishing efficiency of chemical mechanical polishing using an optical end-point detector as well as a chemical mechanical polishing method.

Other objects and advantages of the present invention will become apparent from the following description.

Firstly, the above objects and advantages of the present invention are attained by a chemical mechanical polishing pad which comprises a water-insoluble matrix and water-soluble particles dispersed in the water-insoluble matrix material and has a polishing surface and a non-polishing surface on a side opposite to the polishing surface, wherein the pad has a light transmitting area which optically communicates from the polishing surface to the non-polishing surface, and the non-polishing surface of the light transmitting area has a surface roughness (Ra) of 10 μm or less.

Secondly, the above objects and advantages of the present invention are attained by a chemical mechanical polishing laminated pad comprising the above chemical mechanical polishing pad of the present invention and a base layer formed on the non-polishing surface of the polishing pad, the base layer having a light transmitting area extending in its thickness direction, and the light transmitting area optically communicating with the light transmitting area of the chemical mechanical polishing pad.

Thirdly, the above objects and advantages of the present invention are attained by a chemical mechanical polishing method using the above chemical mechanical polishing pad or the above chemical mechanical polishing laminated pad, wherein the end point of chemical mechanical polishing is detected by an optical end-point detector.

DETAILED DESCRIPTION OF THE PREFERRED EMBODIMENT

Figure 1:
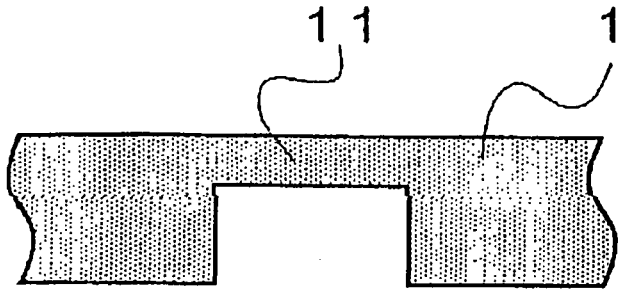
FIG. 1 is a sectional view of an example of the thin portion of the polishing pad of the present invention.
Figure 2:
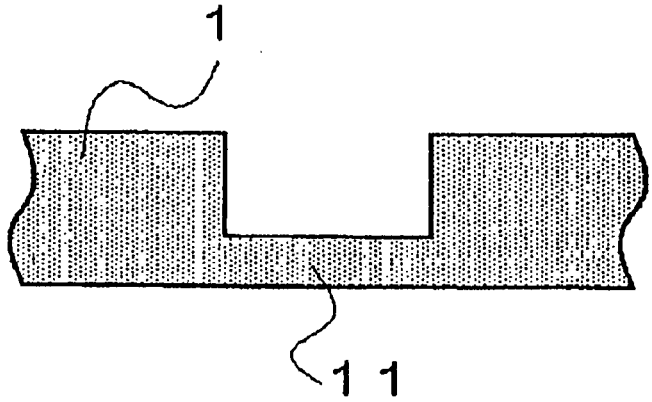
FIG. 2 is a sectional view of another example of the thin portion of the polishing pad of the present invention.
Figure 3:
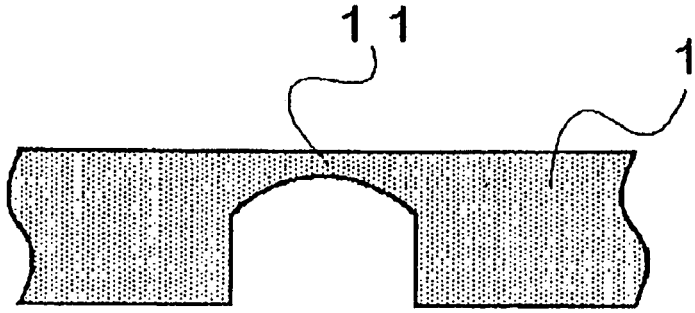
FIG. 3 is a sectional view of still another example of the thin portion of the polishing pad of the present invention.
Figure 4:
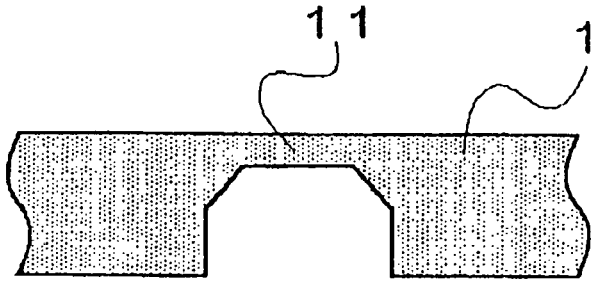
FIG. 4 is a sectional view of a further example of the thin portion of the polishing pad of the present invention.

The chemical mechanical polishing pad of the present invention will be described in detail hereinunder.

The chemical mechanical polishing pad of the present invention (may be referred to as "polishing pad" hereinafter) comprises a water-insoluble matrix and water-soluble particles dispersed in the water-insoluble matrix material.

The material forming the water-insoluble matrix is, for example, a thermoplastic resin, thermosetting resin, elastomer or crude rubber.

Examples of the above thermoplastic resin include polyolefin resins, polystyrene resins, polyacrylic resins, vinyl ester resins (excluding polyacrylic resins), polyester resins, polyamide resins, fluororesin, polycarbonate resins and polyacetal resins.

The polyacrylic resins include (meth)acrylate resins.

Examples of the above thermosetting resin include phenolic resins, epoxy resins, unsaturated polyester resins, polyurethane resins, polyurethane-urea resins, urea resins and silicon resins.

Examples of the elastomer include styrene-based elastomers, thermoplastic elastomers and other elastomers.

The styrene-based elastomers include styrene-butadiene-styrene block copolymer (SBS) and hydrogenated block copolymer thereof (SEBS). The thermoplastic elastomers include polyolefin elastomers (TPO), thermoplastic polyurethane elastomers (TPU), thermoplastic polyester elastomers (TPEE), polyamide elastomers (TPAE) and diene-based elastomers.

The other elastomers include silicone resin-based elastomers and fluororesin-based elastomers.

The diene-based elastomers include 1,2-polybutadiene.

The above polyolefin elastomers include polyethylene.

The above fluororesin-based elastomers include polyvinylidene fluoride.

Examples of the above crude rubber include butadiene rubber, styrene·butadiene rubber, isoprene rubber, isobutylene·isoprene rubber, acrylic rubber, acrylonitrile·butadiene rubber, ethylene·propylene rubber, ethylene·propylene·diene rubber, silicone rubber and fluorine rubber.

The material forming the water-insoluble matrix may partly have at least one selected from acid anhydride group, carboxyl group, hydroxyl group, epoxy group and amino group. When the material has one of the above groups, its compatibility with water-soluble particles, abrasive grains and aqueous medium which will be described hereinafter can be adjusted.

The material forming the above water-insoluble matrix preferably transmits at least part of end-point detection light from an optical end-point detector.

The above materials forming the water-insoluble matrix may be used alone or in combination of two or more.

The material forming the above water-insoluble matrix may or may not have a crosslinked structure but preferably, at least part of it has a crosslinked structure.

The expression "at least part of it has a crosslinked structure" means that when only one material is used, at least part of the material has a crosslinked structure or that when two or more different materials are used, at least part of one material out of these has a crosslinked structure.

When at least part of the material forming the water-insoluble matrix has a crosslinked structure, elastic recovery force can be provided to the water-insoluble matrix. Therefore, as displacement caused by shear stress applied to the polishing pad at the time of polishing can be suppressed, it is possible to prevent pores from being filled by the plastic deformation of the water-insoluble matrix when it is excessively stretched at the time of polishing and conditioning. It is also possible to prevent the surface of the polishing pad from being fluffed excessively. Consequently, the retainability of slurry at the time of polishing is high, the retainability of the slurry is easily recovered by conditioning, and further the scratching of the surface to be polished can be prevented.

Examples of the material having a crosslinked structure include materials obtained by crosslinking polyacrylic resins and vinyl ester resins (excluding polyacrylic resins) out of the above thermoplastic resins; polyurethane resins, epoxy resins and unsaturated polyester resins out of the above thermosetting resins; diene-based elastomers and fluororesin-based elastomers out of the above elastomers; and butadiene rubber, isoprene rubber, acrylic rubber, acrylonitrile·butadiene rubber, styrene·butadiene rubber, ethylene·propylene rubber, silicone rubber, fluorine rubber and styrene·isoprene rubber out of the above rubbers. The crosslinking reaction can be carried out in the presence of a crosslinking agent such as sulfur or peroxide or through exposure to ultraviolet radiation or electron beam. An ionomer may also be used to carry out a crosslinking reaction by ionic bonding.

When a material having a crosslinked structure is used, a crosslinked material may be used, or a crosslinking agent may be used in the step of dispersing the water-soluble particles in the water-insoluble matrix, which will be described hereinafter, to carry out a crosslinking reaction. The crosslinking reaction may be carried out in the presence of a compound (co-crosslinkable compound) having at least two double bonds in the molecule together with a crosslinking agent.

Out of these materials having a crosslinked structure, 1,2-polybutadiene at least part of which is crosslinked is particularly preferred because it can provide sufficiently high transmission properties for end-point detection light from an optical end-point detector, is stable to a strong acid or strong alkali contained in many kinds of slurry for chemical mechanical polishing and further is rarely softened by water absorption. The 1,2-polybutadiene at least part of which is crosslinked may be used alone or mixed with other material. The other material which can be mixed with the 1,2-polybutadiene at least part of which is crosslinked is, for example, butadiene rubber or isoprene rubber.

The residual elongation at break of the matrix material at least partly having a crosslinked structure is preferably 0 to 100%, more preferably 0 to 10%, particularly preferably 0 to 5%. When the residual elongation at break is higher than 100%, fine pieces scraped off or stretched from the surface of the polishing pad at the time of chemical mechanical polishing and conditioning tend to fill the pores.

The "residual elongation at break" is an elongation obtained by subtracting the distance between bench marks before the test from the total distance between each bench mark and the broken portion of the broken and divided specimen in a tensile test in which a dumbbell-shaped specimen No. 3 is broken at a tensile rate of 500 mm/min and a test temperature of 80° C. in accordance with the "vulcanized rubber tensile test method" specified in JIS K 6251.

The polishing pad of the present invention comprises water-soluble particles dispersed in the above water-insoluble matrix material.

The above water-soluble particles are dispersed in the water-insoluble matrix material and separate from the surface of the polishing pad when they dissolve or gel upon contact with an aqueous medium contained in the slurry for chemical mechanical polishing to be supplied from the outside at the time of chemical mechanical polishing. Pores capable of holding the slurry and temporarily retaining the residual dust after polishing are formed at the sites of separation.

The water-soluble particles are not limited to a particular shape and preferably almost spherical, more preferably spherical. The water-soluble particles are preferably uniform in shape. Thereby, the formed pores are uniform in properties and high-quality polishing can be carried out. The word "spherical" means not only spherical but also substantially spherical.

The size of the water-soluble particles is not particularly limited. The water-soluble particles have a particle diameter of preferably 0.1 to 500 μm, more preferably 0.5 to 100 μm, particularly preferably 1 to 80 μm. When the particle diameter is smaller than 0.1 μm, the formed pores may become smaller than the abrasive grains contained in the slurry for chemical mechanical polishing generally used and the abrasive grains may not be fully held in the pores disadvantageously. When the particle diameter is larger than 500 μm, the formed pores become too big, whereby the mechanical strength and polishing rate of the polishing pad may lower.

The material forming the water-soluble particles is not particularly limited and various materials may be used. For example, organic water-soluble particles or inorganic water-soluble particles may be used.

Examples of the above organic water-soluble particles include water-soluble particles made of dextrin, cyclodextrin, mannitol, saccharides, celluloses, starch, protein, polyvinyl alcohol, polyvinyl pyrrolidone, polyacrylic acid, polyethylene oxide, water-soluble photosensitive resins, sulfonated polyisoprene and sulfonated polyisoprene copolymers.

The saccharides include lactose, and the celluloses include hydroxypropyl cellulose and methyl cellulose.

Examples of the above inorganic water-soluble particles include water-soluble particles made of potassium acetate, potassium nitrate, potassium carbonate, potassium hydrogencarbonate, potassium chloride, potassium bromide, potassium phosphate and magnesium nitrate.

These water-soluble particles may be used alone or in combination of two or more. The water-soluble particles may be made of a predetermined single material, or two or more different materials.

The water-soluble particles contained in the polishing pad of the present invention have the function of increasing the indentation hardness of the polishing pad in addition to the function of forming pores in the vicinity of the surface of the polishing pad. Pressure applied to the surface to be polished by the polishing pad can be increased by this high indentation hardness, thereby making it possible to improve the polishing rate and to obtain high polishing flatness. Therefore, the water-soluble particles are preferably solid particles which can ensure sufficiently high indentation hardness for the polishing pad.

Preferably, only water-soluble particles exposed to the surface of the polishing pad dissolve in water whereas water-soluble particles existent in the inside of the polishing pad and not exposed to the surface do not absorb moisture or gel. Therefore, from this point of view, the water-soluble particles may have an outer shell for suppressing moisture absorption on at least part of the surface. Examples of the material forming this outer shell include epoxy resin, polyimide, polyamide and polysilicate.

The amount of the water-soluble particles contained in the polishing pad of the present invention is preferably 30 vol % or less, more preferably 0.1 to 25 vol %, particularly preferably 0.5 to 20 vol % based on 100 vol % of the total of the above water-insoluble matrix and the water-soluble particles. When the amount of the water-soluble particles is larger than 30 vol % transparency for end-point detection light from the optical end-point detector may become unsatisfactory and end-point detection may become difficult according to circumstances.

The polishing pad of the present invention comprises the above water-insoluble matrix and water-soluble particles and may further contain other additives as required.

The other additives which can be contained in the polishing pad of the present invention include a compatibilizing agent, filler, surfactant, abrasive grains, softening agent, antioxidant, ultraviolet light absorber, antistatic agent, lubricant and plasticizer.

Examples of the above compatibilizing agent include water-soluble polymers having at least two groups selected from acid anhydride group, carboxyl group, hydroxyl group, epoxy group, oxazoline group and amino group in the molecule, and other coupling agents.

Examples of the above filler which can be added to improve the stiffness of the polishing pad include calcium carbonate, magnesium carbonate, talc and clay.

The above surfactant is, for example, a cationic surfactant, anionic surfactant or nonionic surfactant. Examples of the cationic surfactant include aliphatic amine salts and aliphatic ammonium salts. Examples of the anionic surfactant include fatty acid soap, carboxylates such as alkyl ether carboxylates, sulfonates such as alkylbenzene sulfonates, alkylnaphthalene sulfonates and α-olefin sulfonates, sulfates such as higher alcohol sulfates, alkyl ether sulfates and polyoxyethylene alkylphenyl ether sulfates, and phosphates such as alkyl phosphates. Examples of the nonionic surfactant include ether type nonionic surfactants such as polyoxyethylene alkyl ethers, ether ester type nonionic surfactants such as polyoxyethylene ethers of glycerin ester, and ester type nonionic surfactants such as polyethylene glycol fatty acid esters, glycerin esters and sorbitan esters.

The polishing pad of the present invention may contain abrasive grains. In this case, chemical mechanical polishing can be carried out by supplying water in place of an aqueous dispersion for chemical mechanical polishing. When the polishing pad of the present invention contains abrasive grains, at least one selected from oxidizing agent, scratch prevention agent and pH modifier is preferably contained together with the abrasive grains.

Examples of the above abrasive grains include silica, alumina, ceria, zirconia and titania particles. They may be used alone or in combination of two or more.

Examples of the above oxidizing agent include organic peroxides such as hydrogen peroxide, peracetic acid, perbenzoic acid and tert-butyl hydroperoxide, permanganic acid compounds such as potassium permanganate, bichromic acid compounds such as potassium bichromate, halogen acid compounds such as potassium iodate, nitric acid compounds such as nitric acid and iron nitrate, perhalogen acid compounds such as perchloric acid, persulfuric acid salts such as ammonium persulfate, and heteropoly-acids. Out of these oxidizing agents, hydrogen peroxide and organic peroxides whose decomposed products are harmless and persulfates such as ammonium persulfate are particularly preferred.

Examples of the above scratch prevention agent include biphenol, bipyridyl, 2-vinylpyridine, 4-vinylpyridine, salicylaldoxime, o-phenylenediamine, m-phenylenediamine, catechol, o-aminophenol, thiourea, N-alkyl group-containing (meth)acryallmide, N-aminoalkyl group-containing (meth)acrylamide, 7-hydroxy-5-methyl-1,3,4-triazaindolizine, 5-methyl-1H-benzotriazole, phthalazine, melamine and 3-amino-5,6-dimethyl-1,2,4-triazine.

The above pH modifier is a component other than the above compounding additives and shows acidity or alkalinity upon contact with water. Examples of the pH modifier include acids other than the above acids, ammonia and hydroxides of alkali metals. The hydroxides of alkali metals include sodium hydroxide, potassium hydroxide, rubidium hydroxide and cesium hydroxide.

The polishing pad of the present invention can be manufactured by mixing together the above water-insoluble matrix, water-soluble particles and optional additives and molding the mixture.

Any means may be used in the above mixing step if the water-soluble particles can be dispersed in the water-insoluble matrix. For example, the water-insoluble matrix, water-soluble particles and optional additives may be kneaded together.

The method of dispersing the water-soluble particles in the water-insoluble matrix is not particularly limited. For example, the material forming the water-insoluble matrix and the water-soluble particles and optional additives may be kneaded together. The material forming the water-insoluble matrix is preferably kneaded under heating to be easily processed, and the water-soluble particles are preferably solid at this heating temperature. When they are kneaded together at the temperature at which the water-soluble particles are solid, the water-soluble particles can be easily dispersed in the water-insoluble matrix while they assume the above preferred average particle diameter irrespective of compatibility between the particles and the material forming the water-insoluble matrix. Therefore, the type of the water-soluble particles is preferably selected according to the processing temperature of the matrix material in use.

The above kneading can be carried out with an extruder, kneader or Banbury mixer.

After the water-soluble particles are dispersed in the water-insoluble matrix, the chemical mechanical polishing pad of the present invention can be obtained by press molding, injection molding or cast molding the obtained dispersion.

The shape of the polishing pad of the present invention is not particularly limited and may be disk-like, polygonal pillar-like, belt-like or roll-like. The size of the polishing pad is not particularly limited. The diameter when the polishing pad is like a disk, the length of the longest diagonal line when the polishing pad is like a polygonal pillar and the width when the polishing pad is like a belt or roll is 100 to 1,200 mm.

The thickness of the polishing pad of the present invention is preferably 0.1 to 5 mm, more preferably 0.5 to 3 mm.

The Shore D hardness of the polishing pad of the present invention is preferably 35 to 100, more preferably 50 to 80. When the hardness is within this range, polishing efficiency having good balance between the polishing rate and the flattening efficiency of the surface to be polished can be obtained.

The polishing pad of the present invention has a light transmitting area which optically communicates from the polishing surface to the non-polishing surface. The surface roughness (Ra) of the rear surface (non-polishing surface) of the light transmitting area is 10 μm or less, preferably 8 μm or less, more preferably 7 μm or less. When this value is larger than 10 μm, the detection of the polishing end point by the optical end-point detector may become difficult.

The above surface roughness (Ra) is defined by the following equation (1).

$$Ra=\Sigma|Z-Zav|/N \quad (1)$$

In the above equation, N is the number of measurement points, Z is the height of a roughness curve, and Zav is the average height of roughness curves.

In order to obtain a polishing pad having an area with the above surface roughness, the surface of a mold corresponding to the above area of the polishing pad is planished in the case of press molding, or the area which should have light transmission properties of the polishing pad after molding may be polished with abrasive paper or abrasive cloth. Further, a transparent film having the above surface roughness may be bonded or coated to the area which should have light transmission properties of the polishing pad after molding to attain the object of the present invention.

The expression "have light transmission properties" does not always mean that the area transmits light completely but that the area can transmit part of end-point detection light from the optical end-point detector. For example, the transmittance of light having a wavelength between 100 and 3,000 nm (particularly a wavelength between 400 and 800 nm) is preferably 8% or more, more preferably 10% or more, particularly preferably 12% or more.

The above transmittance does not need to be higher than required and may be 70% or less. Even when it is 65% or less or 60% or less, the object of the present invention can be attained.

The transmittance of light having a wavelength of 633 nm is preferably 8 to 70%, more preferably 10 to 65%, particularly preferably 12 to 60%.

The polishing pad of the present invention may be of any kind if the above requirements are satisfied. Preferably, part of the polishing pad is made thin to form the above light transmitting area.

For example, the polishing pad of the present invention has a weakly light transmitting area having lower light transmission properties than those of the light transmitting area, in addition to the light transmitting area, and the light transmitting area is surrounded by the weakly light transmitting area. In this case, the light transmitting area caves in the weakly light transmitting area on the non-polishing side, whereby the thickness of the light transmitting area becomes smaller than the thickness of the weakly light transmitting area.

When light is transmitted through a light transmitting object, the intensity of the light attenuates in proportion to the square of the light transmission distance of the object. Therefore, by making the light transmitting portion thin, the transmittance can be greatly improved. When the polishing pad of the present invention has the above thickness, even if it hardly transmits light having intensity high enough for end-point detection, the thin portion can ensure light intensity high enough for end-point detection.

Therefore, the polishing pad of the present invention preferably has a thin portion. This thin portion is a portion having a smaller thickness than the maximum thickness of the polishing pad. Reference 1 in FIGS. 1 to 4 denotes the polishing pad and 11 the thin portion. This thin portion is not limited to a particular planar shape and may be circular, fan-shaped, that is, a shape formed by cutting out a circle or ring at a predetermined angle, polygonal such as square, rectangular or trapezoidal, or annular. The cross section of the thin portion is, for example, polygonal (tetragonal or pentagonal), dome-shaped or other (see FIGS. 1 to 4, the upper side in these figures is the polishing side).

Figure 5:
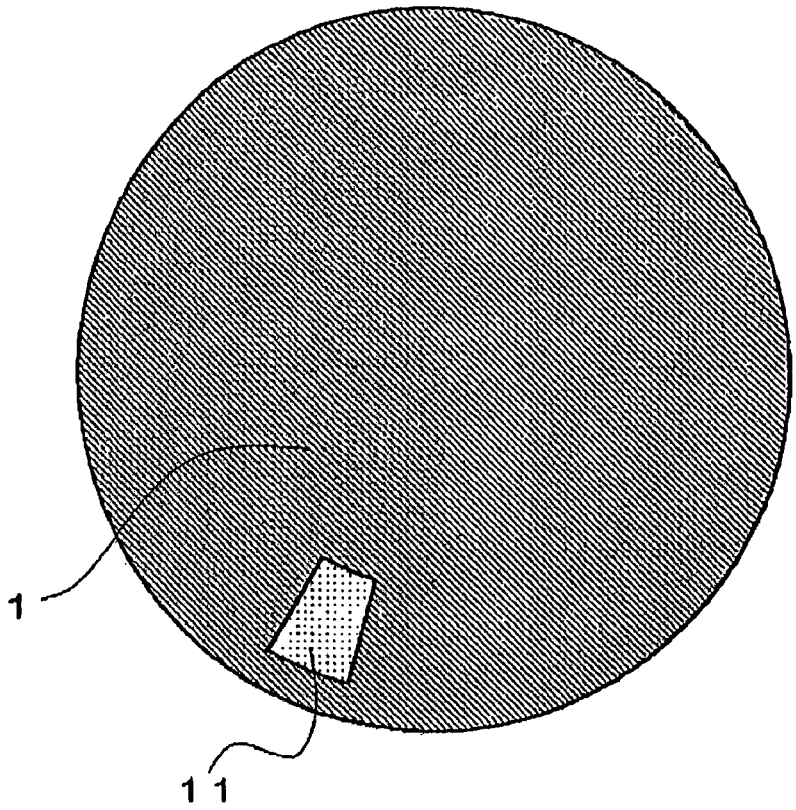
FIG. 5 is a bottom plan view of an example of the thin portion of the present invention.
Figure 6:
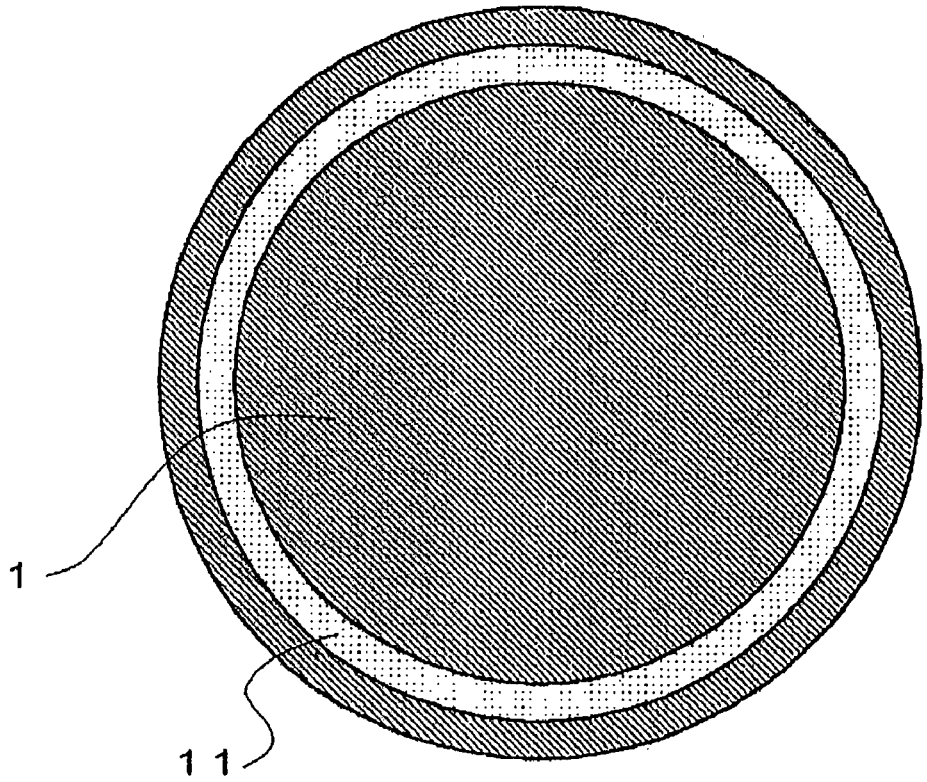
FIG. 6 is a bottom plan view of the thin portion of the present invention.
Figure 7:
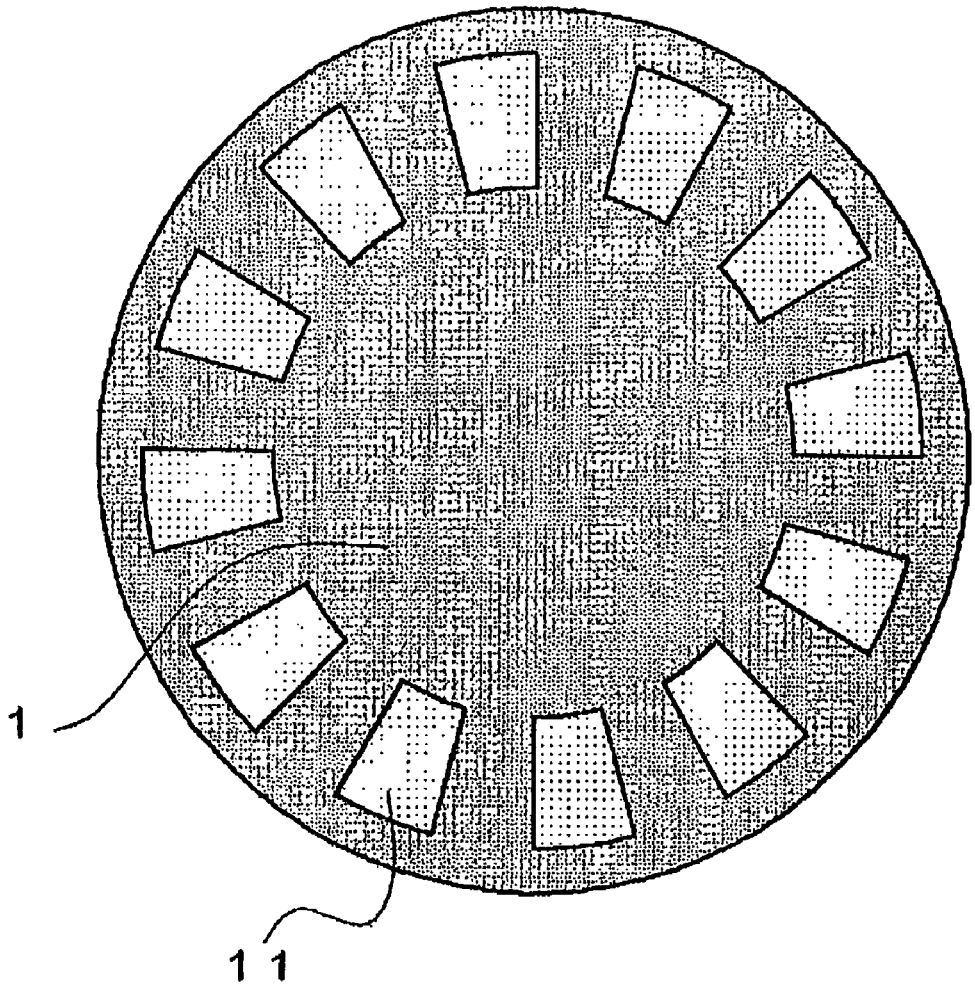
FIG. 7 is a bottom plan view of the thin portions of the present invention.

The number of thin portions of the polishing pad is not particularly limited and may be one or more. The position(s) of the thin portion(s) is/are not particularly limited. When the polishing pad has only one thin portion, it may be arranged as shown in FIG. 5 and FIG. 6. When the polishing pad has two or more thin portions, they may be formed concentrically (FIG. 7).

The thickness of each thin portion is not particularly limited. In general, the smallest thickness of the thin portion is preferably 0.1 to 3.0 mm, more preferably 0.3 to 3 mm. When the thickness of the thin portion is smaller than 0.1 mm, sufficiently high mechanical strength is hardly obtained for this portion.

The size of the thin portion is not particularly limited. For instance, when the thin portion is circular, its diameter is preferably 5 mm or more, when it is annular, its width is preferably 5 mm or more, and when it is rectangular, it is preferably 10 mm or more long and 5 mm or more wide.

Further, the thin portion may be formed by indenting the front surface of the polishing pad (see FIG. 2), preferably formed by indenting the rear surface of the polishing pad (see FIG. 1). When the rear surface is indented, excellent light transmission properties can be obtained without affecting polishing efficiency.

In the present invention, the above "weakly light transmitting area" is an area having lower light transmission properties than those of the light transmitting area. The weakly light transmitting area may be an area which does not transmit light having a wavelength of 100 to 3,000 nm and is not limited to the above area. For example, when the transmittance of the light transmitting area is 8%, the weakly light transmitting area must have a transmittance lower than 8% at the same wavelength. When the transmittance of the light transmitting area is 10%, the weakly light transmitting area must have a transmittance lower than 10% and when the transmittance of the light transmitting area is 12%, the weakly light transmitting area must have a transmittance lower than 12%. Similarly, when the transmittance of the light transmitting area is high, for example, 70%, the weakly light transmitting area must have a transmittance lower than 70%, for example, 60%.

The polishing pad of the present invention may have a recessed portion at the center of the non-polishing surface, in addition to the above thin portion. The expression "at the center" means not only that the recessed portion is located at the center in the mathematically strict sense but also that the center of the non-polishing surface of the polishing pad may be located within the area of the above recessed portion.

The polishing pad having this recessed portion can disperse a local pressure rise caused by the pressure of the polishing head at the time of polishing and improves the surface state of the polished surface.

The above recessed portion is not limited to a particular shape but preferably circular or polygonal, particularly preferably circular. When the recessed portion is circular, the upper limit of its diameter is preferably 100%, more preferably 75%, particularly preferably 50% of the diameter of a wafer as a workpiece to be polished. When the recessed portion is circular, the lower limit of its diameter is preferably 1 mm, more preferably 5 mm irrespective of the size of the wafer as a workpiece.

For example, when the diameter of the wafer is 300 mm, the diameter of the circular recessed portion is preferably 1 to 300 mm, more preferably 1 to 225 mm, particularly preferably 5 to 150 mm. When the diameter of the wafer is 200 mm, the diameter of the circular recessed portion is preferably 1 to 200 mm, more preferably 1 to 150 mm, particularly preferably 1 to 120 mm.

Grooves having a width of 0.1 to 2 mm, for example, a certain depth and a certain interval, or a dot pattern may be optionally formed on the polishing surface of the polishing pad in order to improve the retainability of slurry and the dischargeability of the used slurry. The grooves and dot pattern may be arranged in any form such as concentric, lattice-like, spiral or radial form.

The chemical mechanical polishing laminated pad of the present invention (to be simply referred to as "polishing laminated pad" hereinafter) comprises the chemical mechanical polishing pad of the present invention and a base layer formed on the non-polishing surface of the polishing pad, the base layer has a light transmitting area extending in its thickness direction, and the light transmitting area optically communicates with the light transmitting area of the above chemical mechanical polishing pad. The base layer is not limited to a particular shape and may be circular or polygonal (tetragonal). It preferably has the same planar shape as the polishing pad and is like a thin sheet. The number of base layers is not limited and may be one or more. When two or more base layers are formed, they may be of the same type or different types.

The total thickness of the base layer(s) is not particularly limited but preferably 0.1 to 2 times the thickness of the polishing pad. The hardness of the base layer(s) is not particularly limited but preferably 10 to 80, more preferably 20 to 50 in terms of Shore D hardness. When the laminated pad comprises a base layer(s) having this hardness, the polishing laminated pad of the present invention can have sufficiently high flexibility and suitable conformity to the unevenness of the surface to be polished.

Preferably, the base layer(s) has/have light transmission properties in at least part of the light transmitting area of the polishing pad not to impair the light transmission properties of the polishing pad. As for the base layer(s) having light transmission properties, the material forming the base layer(s) may transmit light for end-point detection applied from the optical end-point detector, or part of the base layer(s) may be made thin or cut away to provide light transmission properties. Further, a light transmitting member may be bonded to a cut-away portion.

The expression "having light transmission properties" means the same as that in the above-described polishing pad.

The polishing pad and the polishing laminated pad of the present invention can be advantageously used in a chemical mechanical polishing machine equipped with an optical end-point detector. The optical end-point detector is a device capable of detecting the polishing end point of the surface to be polished from light reflected from the surface by transmitting light to the polishing side from the rear side of the polishing pad. Other measurement principles are not particularly limited.

The chemical mechanical polishing method of the present invention is a chemical mechanical polishing method using the polishing pad or polishing laminated pad of the present invention and characterized in that the detection of the chemical mechanical polishing end point is carried out with an optical end-point detector.

The above optical end-point detector is the same as above. According to the chemical mechanical polishing method of the present invention, polishing can be carried out at a sufficiently high polishing rate while the polishing end point is always checked and can be ended at the optimum polishing end point, and an excellent polished surface state can be obtained.

Figure 8:
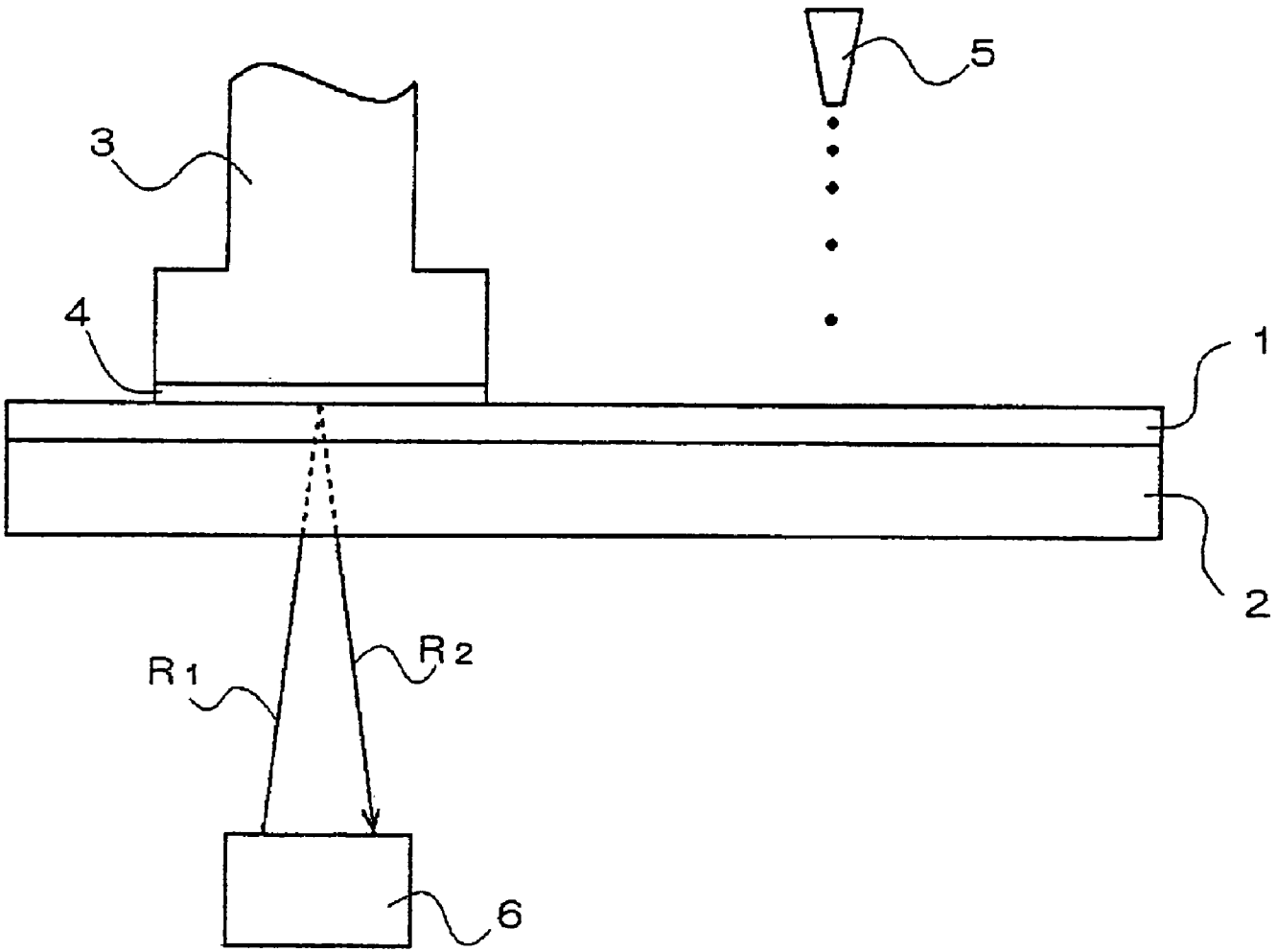
FIG. 8 is a diagram of a polishing machine using the polishing pad or polishing laminated pad of the present invention.

In the chemical mechanical polishing method of the present invention, for example, the polishing machine as shown in FIG. 8 can be used. That is, the polishing machine comprises a rotatable platen 2, a pressure head 3 which can turn and move in both vertical and horizontal directions, a slurry feed unit 5 for dropping slurry on the platen in a predetermined amount per unit time, and an optical end-point detector 6 installed below the platen.

In this polishing machine, the polishing pad or polishing laminated pad of the present invention is fixed on the platen, and a workpiece to be polished, for example, a semiconductor wafer 4 is fixed on the under surface of the pressure head and pressed against the polishing pad at a predetermined pressure. The platen and the pressure head are turned while slurry or water is dropped on the platen from the slurry feed unit in a predetermined amount each time to polish the workpiece by its slide contact with the polishing pad.

End-point detection radiation $R_1$ having a predetermined wavelength or wavelength range is applied to the surface to be polished of the workpiece from below the platen (the platen itself has light transmission properties or part of the platen is cut away to transmit end-point detection radiation)

by the optical end-point detector 6. Reflected radiation $R_2$ obtained by reflecting this end-point detection radiation $R_1$ from the surface to be polished of the workpiece is seized by the optical end-point detector so that polishing can be carried out while the state of the surface to be polished is checked from this reflected radiation.

EXAMPLES

The following examples are provided to further illustrate the present invention.

Example 1

98 vol % of 1,2-polybutadiene (JSR RB830 of JSR Corporation) which would be crosslinked later to become a water-insoluble matrix and 2 volt of β-cyclodextrin (trade name: Dexy Pearl β-100 of KK Bio Research Corporation of Yokohama) as water-soluble particles were kneaded together by a kneader heated at 120° C. Thereafter, dicumyl peroxide (trade name: Percumyl D of NOF Corporation) was added in an amount of 0.32 part by mass based on 100 parts by mass of the total of 1,2-polybutadiene and β-cyclodextrin and further kneaded. Then, a crosslinking reaction was carried out in a press mold having a planished convex portion (21 mm×59 mm×0.6 mm) at 170° C. for 20 minutes to mold a polishing pad having a diameter of 79 mm and a thickness of 2.5 mm and a recessed portion measuring 21 mm×59 mm×0.6 mm on the rear surface (non-polishing side). This recessed portion corresponds to the light transmitting area. The surface roughness Ra of this recessed portion was 4.9 μm.

Thereafter, a plurality of annular grooves having an average width of 0.5 mm, an average depth of 1.4 mm and an average pitch of 1.75 mm were formed concentrically on the polishing surface of this polishing pad with a groove cutter.

When the light transmittance at a wavelength of 633 nm of the light transmitting area of the thus formed polishing pad was measured by an UV light absorptiometer (U-2010 of Hitachi, Ltd.), it was 20%.

The polishing efficiency of this polishing pad was evaluated as follows.

(1) Evaluation of Polishing Rate and Scratch

The polishing pad was set on the platen of a polishing machine (Type: Lap Master LM-15 of SFT Co., Ltd.), and an $SiO_2$ film wafer (trade name: PE-TEOS of Advantec Co., Ltd.) was polished for 2 minutes at a platen revolution of 50 rpm by supplying chemical mechanical polishing slurry diluted to 3 times (trade name: CMS 1101 of JSR Corporation) at a flow rate of 100 mL/min to evaluate the polishing rate and the existence of a scratch. The polishing rate was obtained by measuring the thickness of the film before and after polishing with an optical film thickness meter and dividing the obtained difference in film thickness by the polishing time. The existence of a scratch was checked by observing the polished surface of the $SiO_2$ film wafer after polishing through an electron microscope. As a result, the polishing rate was 350 nm/min and a scratch was rarely observed.

(2) Evaluation of Dishing

When a semiconductor wafer having a pattern (trade name: SKW-7 of SKW Co., Ltd.) was polished under the following conditions, optical end-point detection could be made through the light transmitting area. Thereafter, the dishing of the semiconductor wafer was measured at a line width of 100 μm (pitch of 100 μm) with a micro-shape measuring instrument (Type: P-10 of KLA-Tencor Co., Ltd.). The polished surface had excellent flatness with a dishing of 30 nm.

Slurry; CMS1101 (JSR Corporation)

Chemical mechanical polishing machine: MIRRA (of Applied Materials Co., Ltd.)
Slurry feed rate; 200 mL/min
Pressure of retainer ring: 5 psi
Membrane pressure: 4.5 psi
Inner tube pressure: 4.5 psi
Platen revolution; 70 rpm
Head revolution; 65 rpm

Example 2

A polishing pad having a diameter of 79 cm and a thickness of 2.5 mm and a recessed portion measuring 21 mm×59 mm×0.6 mm on the rear surface (non-polishing side) was obtained in the same manner as in Example 1 except that 85 volt of 1,2-polybutadiene and 15 volt of β-cyclodextrin were used. This recessed portion corresponds to the light transmitting area. The surface roughness Ra of this recessed portion was 5.3 μm.

Thereafter, a plurality of annular grooves having an average width of 1.0 mm, an average depth of 1.4 mm and an average pitch of 2.00 mm were formed concentrically on the polishing surface of the polishing pad with a groove cutter.

When the light transmittance at a wavelength of 633 nm of the light transmitting area of this polishing pad was measured in the same manner as in Example 1, it was 12%.

(1) Polishing Rate and Existence of a Scratch

When a $SiO_2$ film wafer (trade name: PE-TEOS of Advantec Co., Ltd.) was polished under the same conditions as in Example 1 to evaluate the polishing rate and the existence of a scratch, the polishing rate was 300 nm/min and a scratch was rarely observed.

(2) Evaluation of Dishing

When a semiconductor wafer (trade name: SKW-7 of SKW Co., Ltd.) was polished under the same conditions as in Example 1, optical end-point detection could be made through the light transmitting area. The polished surface had excellent flatness with a dishing of 35 nm.

Comparative Example 1

A polishing pad having a diameter of 79 cm and a thickness of 2.5 mm and a recessed portion measuring 21 mm×59 mm×0.6 mm on the rear surface (non-polishing side) was obtained in the same manner as in Example 1 except that 85 vol % of 1,2-polybutadiene and 15 vol % of β-cyclodextrin were used. This recessed portion corresponds to the light transmitting area. The surface roughness Ra of this recessed portion was 12.5 μm.

Thereafter, a plurality of annular grooves having an average width of 0.5 mm, an average depth of 1.4 mm and an average pitch of 1.75 mm were formed concentrically on the polishing surface of the polishing pad with a groove cutter.

When the light transmittance at a wavelength of 633 nm of the light transmitting area of this polishing pad was measured in the same manner as in Example 1, it was 1%.

(1) Polishing Rate and Existence of a Scratch

When a $SiO_2$ film wafer (trade name: PE-TEOS of Advantec Co., Ltd.) was polished under the same conditions as in Example 1 to evaluate the polishing rate and the existence of a scratch, the polishing rate was 400 nm/min and a scratch was rarely observed.

(2) Evaluation of Dishing

When a semiconductor wafer (trade name: SKW-7 of SKW Co., Ltd.) was polished under the same conditions as in Example 1, optical end-point detection could not be made through the light transmitting area.

Comparative Example 2

A polishing pad having a diameter of 79 cm and a thickness of 2.5 mm and a recessed portion measuring 21 mm×59 mm×0.6 mm on the rear surface (non-polishing side) was obtained in the same manner as in Example 2 except that a mold having a convex portion whose surface was not planished was used. This recessed portion corresponds to the light transmitting area. The surface roughness Ra of this recessed portion was 1.5 μm.

Thereafter, a plurality of annular grooves having an average width of 1.0 mm, an average depth of 1.4 mm and an average pitch of 2.00 mm were formed concentrically on the polishing surface of the polishing pad with a groove cutter.

When the light transmittance at a wavelength of 633 nm of the light transmitting area of this polishing pad was measured in the same manner as in Example 1, it was 1.5%.

(1) Polishing Rate and Existence of a Scratch

When a $SiO_2$ film wafer (trade name: PE-TEOS of Advantec Co., Ltd.) was polished under the same conditions as in Example 1 to evaluate the polishing rate and the existence of a scratch, the polishing rate was 300 nm/min and a scratch was rarely observed.

(2) Evaluation of Dishing

When a semiconductor wafer (trade name: SKW-7 of SKW Co., Ltd.) was polished under the same conditions as in Example 1, optical end-point detection could not be made through the light transmitting area.

Example 3

A polishing pad having a diameter of 79 cm and a thickness of 2.5 mm and a recessed portion measuring 21 mm×59 mm×0.6 mm on the rear surface (non-polishing side) was obtained in the same manner as in Example 1 except that 5 vol % of anhydrous potassium carbonate (of Wako Pure Chemical Industries, Ltd.) was used in place of β-cyclodextrin. This recessed portion corresponds to the light transmitting area. The surface roughness Ra of this recessed portion was 4.5 μm.

Thereafter, a plurality of annular grooves having an average width of 1.0 mm, an average depth of 1.4 mm and an average pitch of 2.00 mm were formed concentrically on the polishing surface of the polishing pad with a groove cutter.

When the light transmittance at a wavelength of 633 nm of the light transmitting area of this polishing pad was measured in the same manner as in Example 1, it was 13%.

(1) Polishing Rate and Existence of a Scratch

When a $SiO_2$ film wafer (trade name; PE-TEOS of Advantec Co., Ltd.) was polished under the same conditions as in Example 1 to evaluate the polishing rate and the existence of a scratch, the polishing rate was 290 nm/min and a scratch was rarely observed.

(2) Evaluation of Dishing

When a semiconductor wafer (trade name: SKW-7 of SKW Co., Ltd.) was polished under the same conditions as in Example 1, optical end-point detection could be made through the light transmitting area. The polished surface had excellent flatness with a dishing of 40 nm.

Example 4

28.2 parts by mass of polytetramethylene glycol having two hydroxyl groups at both terminals of the molecule and a number average molecular weight of 650 (trade name: PTMG650 of Mitsubishi Chemical Co., Ltd.) and 21.7 parts by mass of 4,4'-diphenylmethane diisocyanate (trade name: Sumijule 44S of Sumika Bayer Urethane Co., Ltd.) were fed to a reactor and maintained at a temperature of 90° C. for 3 hours under agitation to carry out a reaction and then cooled to obtain a prepolymer having an isocyanate group at both terminals.

21.6 parts by mass of polypropylene glycol having three hydroxyl groups and a number average molecular weight of 330 (trade name: Uniol TG330, addition reaction product between glycerin and propylene oxide, of NOF Corporation) and 6.9 parts by mass of the PTMG650 polytetramethylene glycol were used as crosslinking agents, 5 parts by mass of β-cyclodextrin was dispersed in these by agitation, and 0.1 part by mass of 2-methyltriethylenediamine (trade name: Me-DABCO of Sankyo Air Products Co., Ltd.) as a reaction promoting agent was dissolved in the dispersion under agitation. This mixture was added to the reactor for the above prepolymer having an isocyanate group at both terminals.

Further, 21.6 parts by mass of the Sumijule 44S 4,4'-diphenylmethane diisocyanate was added to the reactor for the above prepolymer having an isocyanate group at both terminals and stirred at room temperature at 200 rpm for 2 minutes, and further the obtained reaction product was defoamed under reduced pressure to obtain a raw material mixture.

This raw material mixture was injected into a mold having a planished convex portion (21 mm×59 mm×0.6 mm) and a diameter of 60 cm and a thickness of 3 mm and maintained at 80° C. for 20 minutes to polymerize the polyurethane and further heated at 110° C. for 5 hours to obtain a polishing pad having a diameter of 60 cm and a thickness of 3 mm and a recessed portion measuring 21 mm×59 mm×0.6 mm on the rear side (non-polishing side). The surface roughness Ra of this recessed portion was 4.7 μm.

A plurality of annular grooves having an average width of 1.0 mm, an average depth of 1.4 mm and an average pitch of 2.00 mm were formed concentrically on the polishing surface of this polishing pad with a groove cutter.

When the light transmittance at a wavelength of 633 nm of the light transmitting area of this polishing pad was measured in the same manner as in Example 1, it was 12%.

(1) Polishing Rate and Existence of a Scratch

When a $SiO_2$ film wafer (trade name: PE-TEOS of Advantec Co., Ltd.) was polished under the same conditions as in Example 1 to evaluate the polishing rate and the existence of a scratch, the polishing rate was 310 nm/min and a scratch was rarely observed.

(2) Evaluation of Dishing

When a semiconductor wafer (trade name: SKW-7 of SKW Co., Ltd.) was polished under the same conditions as in Example 1, optical end-point detection could be made through the light transmitting area. The polished surface had excellent flatness with a dishing of 40 nm.

As described above, the chemical mechanical polishing pad and chemical mechanical polishing laminated pad of the present invention can be advantageously used for chemical mechanical polishing using the above optical end-point detector. By the chemical mechanical polishing method of the present invention, polishing can be carried out at a sufficiently high polishing rate while the polishing end point is always checked and can be ended at the optimum polishing end point without failure, and an excellent polished surface state can be obtained.

The priority document of the present application, Japanese Application No. 2003-275740, filed Jul. 17, 2003, is incorporated herein by reference.

What is claimed is:

1. A chemical mechanical polishing pad comprising a water-insoluble matrix and water-soluble particles dispersed in the water-insoluble matrix material and having a polishing surface and a non-polishing surface on a side opposite to the polishing surface, wherein the amount of the water-soluble particles, based on 100 vol. % of the total of the water-insoluble matrix and the water-soluble particles, is 0.1 to 5 vol. %, the pad has a light transmitting area that optically communicates from the polishing surface to the non-polishing surface, and the non-polishing surface of the light transmitting area has a surface roughness (Ra) of 10 μm or less.

2. The chemical mechanical polishing pad according to claim 1 including a weakly light transmitting area having lower light transmission properties than those of the light transmitting area, in addition to the light transmitting area, the light transmitting area being surrounded by the weakly light transmitting area.

3. The chemical mechanical polishing pad according to claim 2, wherein the light transmitting area caves in the weakly light transmitting area on the non-polishing side to make the light transmitting area thinner than the weakly light transmitting area.

4. A chemical mechanical polishing laminated pad comprising the chemical mechanical polishing pad of claim 1 and a base layer formed on the non-polishing surface of the pad, the base layer having a light transmitting area extending in its thickness direction, and the light transmitting area optically communicating with the light transmitting area of the chemical mechanical polishing pad.

5. A chemical polishing machine comprising the chemical mechanical polishing laminated pad according to claim 4 and an optical end-point detector.

6. A chemical mechanical polishing method comprising polishing an object using the chemical mechanical polishing laminated pad of claim 4, and detecting the end point of chemical mechanical polishing with an optical end-point detector.

7. A chemical polishing machine comprising the chemical mechanical polishing pad according to claim 1 and an optical end-point detector.

8. A chemical mechanical polishing method comprising polishing an object using the chemical mechanical polishing pad of claim 1, and detecting the end point of chemical mechanical polishing with an optical end-point detector.

9. The chemical mechanical polishing pad according to claim 1, wherein the water-soluble particles comprise cyclodextrin.

10. The chemical mechanical polishing pad according to claim 1, wherein the water-soluble particles comprise potassium carbonate.

* * * * *